US009633828B2

(12) United States Patent
Lee et al.

(10) Patent No.: US 9,633,828 B2
(45) Date of Patent: Apr. 25, 2017

(54) ION FOCUSING MEMBER AND MASS SPECTROMETER USING THE SAME

(71) Applicant: NATIONAL CHUNG HSING UNIVERSITY, Taichung (TW)

(72) Inventors: Maw-Rong Lee, Taichung (TW); Yen-Hsien Li, Taichung (TW)

(73) Assignee: NATIONAL CHUNG HSING UNIVERSITY, Taichung (TW)

( * ) Notice: Subject to any disclaimer, the term of this patent is extended or adjusted under 35 U.S.C. 154(b) by 0 days.

(21) Appl. No.: 15/057,596

(22) Filed: Mar. 1, 2016

(65) Prior Publication Data

US 2016/0260599 A1 Sep. 8, 2016

(30) Foreign Application Priority Data

Mar. 4, 2015 (TW) ..... 104106924 A

(51) Int. Cl.
*H01J 49/26* (2006.01)
*H01J 49/16* (2006.01)

(52) U.S. Cl.
CPC ..... *H01J 49/167* (2013.01)

(58) Field of Classification Search
USPC ..... 250/281, 282, 283, 288
See application file for complete search history.

(56) References Cited

U.S. PATENT DOCUMENTS 6,800,849 B2 * 10/2004 Staats ..... H01J 49/0431 250/288
2004/0067578 A1 * 4/2004 Axelsson ..... B05B 5/0255 435/287.2
2007/0145263 A1 * 6/2007 Weng ..... B01L 3/502707 250/288

* cited by examiner

*Primary Examiner* — Nicole Ippolito
(74) *Attorney, Agent, or Firm* — Muncy, Geissler, Olds & Lowe, P.C.

(57) ABSTRACT

An ion focusing member includes a ball having a surface with a plurality of dimples. The ion focusing member is adapted for being disposed in a mass spectrometer in a way that the ball is located at a spray path of analyte ions and located between a metal capillary and a mass analyzer. When the analyte ions pass through the ball, the analyte ions can be gathered at a downstream position of the ball, which in turn flow into the mass analyzer by a potential difference. Therefore, the ion focusing member of the present disclosure can effectively enhance the amount of the analyte ions entering into the mass analyzer, thereby improving ion transmission efficiency. As a result, a mass spectrometer equipped with the ion focusing member may have increased signal intensity of analyte, lowered limit of detection (LOD), and minimized detection error.

6 Claims, 7 Drawing Sheets

ION FOCUSING MEMBER AND MASS SPECTROMETER USING THE SAME

BACKGROUND OF THE INVENTION

1. Field of the Invention

The present disclosure relates generally to an ion focusing member and more particularly, to an ion focusing member adapted to be applied in a mass spectrometer for gathering analyte ions. The present disclosure further relates to a mass spectrometer using the ion focusing member.

2. Description of the Related Art

Recently, the mass spectrometer using electrospray ionization (hereinafter referred to as 'ESI') device has been widely used in the fields of identification of synthesized compounds, detection of environmental toxic substances, analysis of energy ingredients, development of drugs, biological metabolomics or pharmacometabolomics, analysis of natural products, food analysis, etc.

In general, a mass spectrometer includes an ionization device, a mass analyzer and a detector. FIG. 1 shows a schematic diagram of ionization mechanism of commercial ESI device 10. The conventional ESI device 10 includes a metal capillary 11 having an open end 111 that opens toward a sample inlet 21 of a mass analyzer 20. When the ESI device 10 is in use, an electric field, for example, a potential difference of 3,000 V to 5,000 V, is established between the open end 111 and the sample inlet 21 of the mass analyzer 20. Subsequently, a sample solution 30 contained in the metal capillary 11 is forced out of the metal capillary 11 for traveling toward the open end 111. The sample solution 30 forms a Taylor Cone T that is filled with electric charges when it passes through the open end 111 due to the electric field present between the open end 111 and the sample inlet 21 and the surface tension of the sample solution 30 at the open end 111. As the electric field force overcomes the surface tension of the sample solution 30 at the open end 111, liquid droplets 31 containing multivalent electric charges are formed, that is, a so-called electrospray phenomenon occurs. The solvent contained in the liquid droplets 31 vaporizes by a nebulization gas 40 to form analyte ions 33 which in turn travel into the mass analyzer 20 through the sample inlet 21, a mass spectrum is thus obtained.

As shown in FIG. 1, because the metal capillary 11 of the conventional ESI mechanism may create the plume-like analyte ions 33, that is, the analyte ions 33 may form a dispersion area much larger than a sectional area of the sample inlet 21 of the mass analyzer 20, at least 50% of the analyte ions 33 cannot flow into the mass analyzer 20. As a result, the mass spectrometer equipped with the conventional ESI device has the problems that the signal strength of analyte is significantly decreased and the detection limit cannot be lowered.

In order to improve the aforesaid problems, many methods for focusing ions to be transmitted into mass spectrometer by controlling electric field such as Field Asymmetric Ion Mobility Spectrometry (hereinafter referred to as 'FAIMS') have been developed. However, FAIMS has limited effect on ion-focusing under the influence of Maxwell's equation and has limited applicability due to its large volume and expensive price as well as it is not adapted to various mass spectrometers.

SUMMARY OF THE INVENTION

In light of the above, it is an objective of the present disclosure to provide an ion focusing member, which can be directly applied to various mass spectrometers, has good applicability, and is capable of effectively enhancing the amount of analyte ions entering into the mass analyzer to improve the signal strength of analyte and lower the detection limit of mass spectrometer.

It is another objective of the present disclosure to provide a mass spectrometer using the aforesaid ion focusing member.

To attain the above-mentioned objective, the present disclosure provides an ion focusing member which is adapted to be applied in a mass spectrometer including a metal capillary for spraying analyte ions and a mass analyzer having a sample inlet. The ion focusing member includes a ball having a surface with a plurality of dimples. The ion focusing member is disposed inside the mass spectrometer in a way that the ball is located at a spray path of the analyte ions and adjacent to the sample inlet of the mass analyzer, thus the ball may have a front side facing toward the metal capillary and a back side facing toward the mass analyzer respectively. As such, when the analyte ions sprayed from the metal capillary flow toward the ball, the analyte ions can be very close to the surface of the ball because of the dimples and then are gathered at a downstream position of the back side of the ball where it is adjacent to the mass analyzer. The analyte ions gathered at the downstream position of the back side of the ball can thus enter into the mass analyzer due to a potential difference established between the metal capillary and the mass analyzer.

In comparison with the conventional ESI device, because the plume-like analyte ions can be efficiently collected at a downstream position of the back side of the ball due to the principle of fluid dynamics and then pass into the mass analyzer, the ion focusing member of the present disclosure can effectively increase the amount of analyte ions entering into the mass analyzer, thereby successfully improving ion transmission efficiency. Accordingly, when the present disclosure is used in a mass spectrometer, the mass spectrometer may have the advantages of increased signal intensity of analyte, minimized detection error and lowered detection limit.

In the ion focusing member of the present disclosure, each of the plurality of dimples on the surface of the ball may have a diameter of between 1 nm and 1 mm.

In the ion focusing member of the present disclosure, each of the plurality of dimples on the surface of the ball may have a depth of 1 nm to less than a radius of the ball.

In the ion focusing member of the present disclosure, it is preferable that the ball is made of a material which is resistant to acidic and basic solutions, organic solvents and a high temperature of 260° C. or more, so as to prevent damage to the ball or avoid causing erroneous analysis results.

On the other hand, a mass spectrometer using the aforesaid ion focusing member is also provided in the present disclosure. The mass spectrometer includes a mass analyzer having a sample inlet, a metal capillary for spraying analyte ions, and the above-mentioned ion focusing member disposed between the mass analyzer and the metal capillary in a way that the ball is located at a spray path of the analyte ions.

Accordingly, when the analyte ions are sprayed to the front side of the ball, the analyte ions will move along the surface of the ball and then be collected between the back side of the ball and the sample inlet of the mass analyzer. Because of the potential difference established between the metal capillary and the mass analyzer, the analyte ions collected at a downstream position of the back side of the ball can thus move toward the sample inlet of the mass analyzer to finally enter into the mass analyzer, such that the amount of the analyte ions entering into the mass analyzer can be enhanced effectively. As a result, the mass spectrometer of the present disclosure may have the advantages of high ion transmission efficiency, minimized detection error and lowered detection limit.

A more detailed constructions and characteristics of the ion focusing member and the mass spectrometer of the present disclosure will be more apparent upon reading the following description in conjunction with the accompanying drawings.

BRIEF DESCRIPTION OF THE DRAWINGS

The present disclosure will be described through the following embodiments with reference to the accompanying drawings wherein.

DETAILED DESCRIPTION OF EMBODIMENTS

Figure 1:
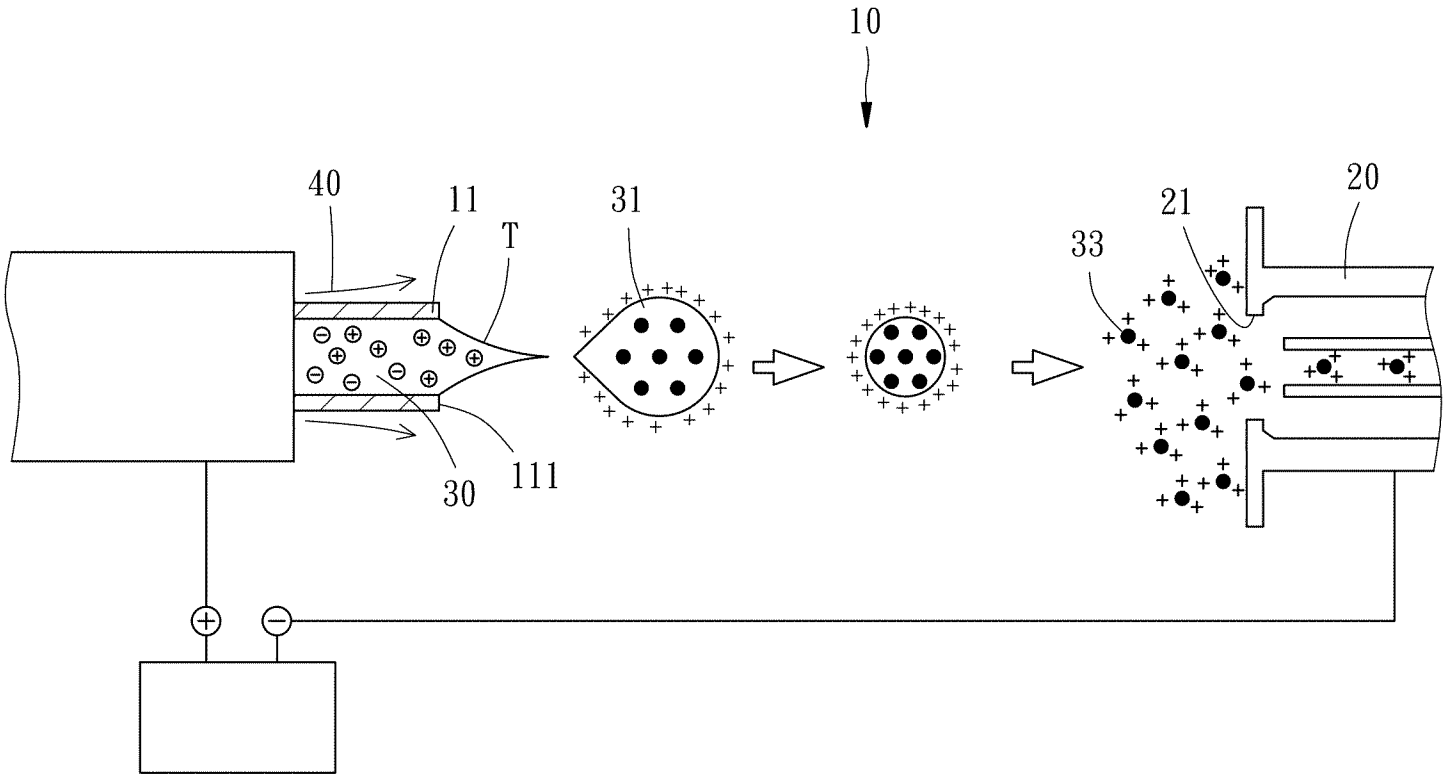
FIG. 1 (Prior Art)
FIG. 1 is a schematic diagram of ionization mechanism of commercial ESI device.

It is to be noted that the drawings of the present disclosure are not drawn in actual scale but are exaggerated to make the construction clearly understandable. In addition, like reference numerals designate like elements throughout the specification.

Figure 2:
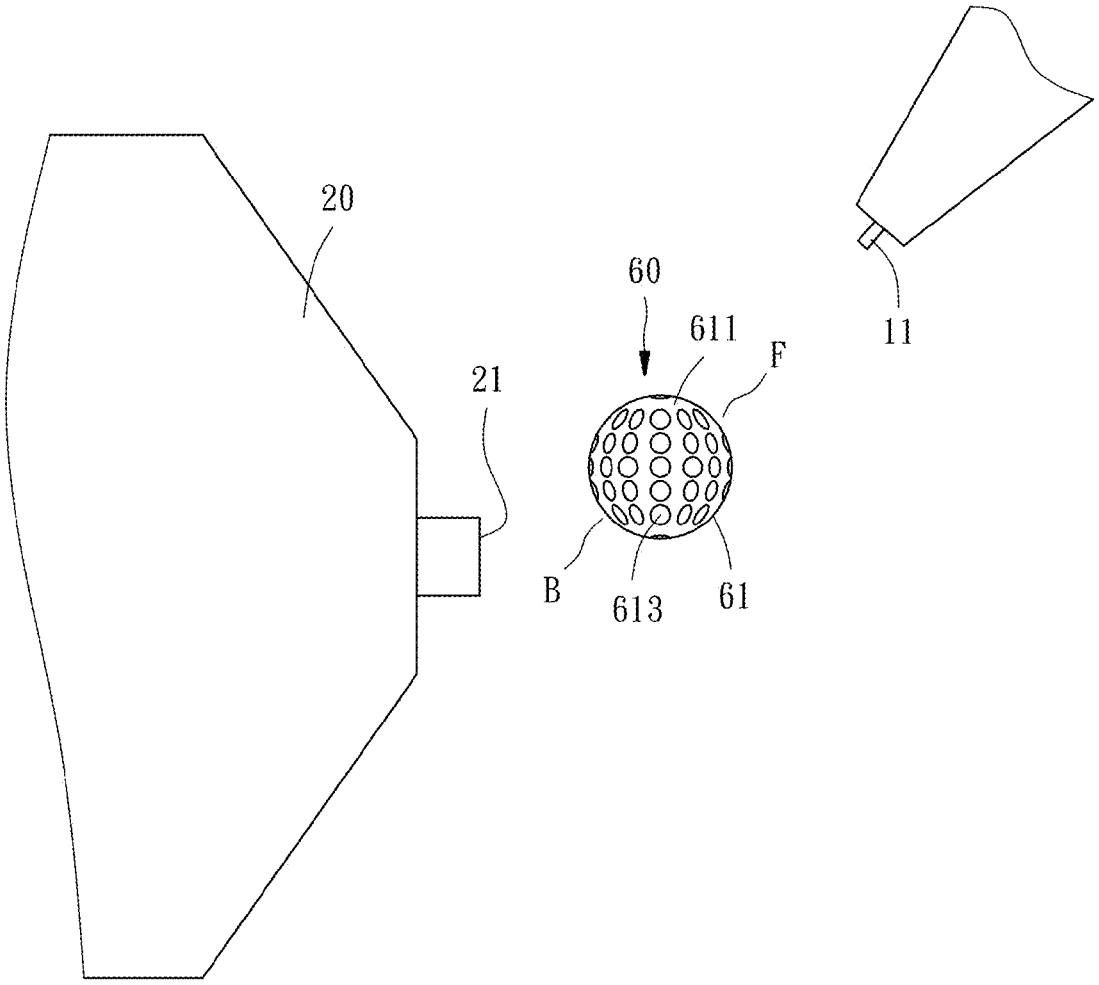
FIG. 2 is a schematic diagram showing that an ion focusing member according to a preferred embodiment of the present disclosure is disposed inside an ionization chamber of a mass spectrometer.

Referring to FIG. 2, an ion focusing member 60 according to a first embodiment of the present disclosure includes a ball 61.

Figure 3:
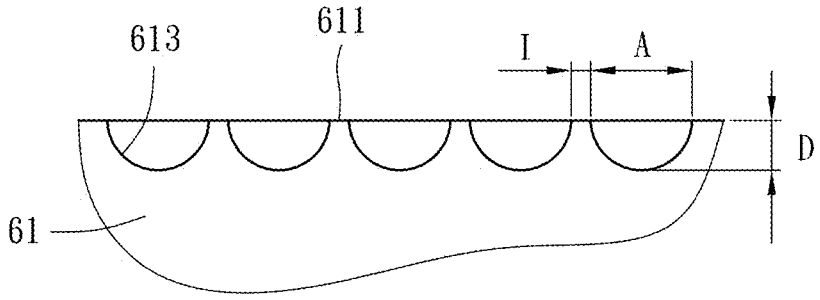
FIG. 3 is a partially enlarged cross-sectional view of the ball of the ion focusing member according to the present disclosure.

The ball 61 has a surface 611 with a plurality of dimples 613. Preferably, the ball 61 is made of a material resistant to acidic and basic solutions, organic solvents and a high temperature of 260° C. or more so as to prevent damage to the ball or avoid causing erroneous analysis results. For example, the ball 61 may be made of polyetheretherketone (PEEK), polyimide (PI), ceramic, or glass, and in the present embodiment the ball 61 is made of PI. Each of the plurality of dimples 613 may have, but not limited to, a cross section of a circle or an ellipse. In fact, the ball 61 may include some dimples 613 having a circular cross-section and some dimples 613 having an elliptical cross-section. Each of the plurality of dimples 613 may have a diameter A of between 1 nm and 1 mm and may have a depth D of 1 nm to less than a radius of the ball 61. There is no specific limit in the pitches I formed between the dimples 613, that is to say, the dimples 613 may be arranged equidistantly or non-equidistantly on the surface of the ball 61. As shown in FIG. 3, the "diameter" A used herein means a length of an opening of each dimple 613 formed on the surface 611, i.e. the distance along the longest axis or the shortest axis. The "depth" D used herein means a distance between the surface 611 and a bottom of the dimple 613. The "pitch" I used herein means a shortest distance between two adjacent edges of two adjacent dimples 613.

In practice, as shown in FIG. 2, the ion focusing member 60 of the embodiment is placed inside an ionization chamber of a mass spectrometer equipped with a metal capillary 11 and a mass analyzer 20 having a sample inlet 21. There is no specific limit in the method for disposing the ion focusing member 60 in the ionization chamber of the mass spectrometer. For example, the ball 61 may have a rod (not shown) inserted therein, and then one end of the rod can be fixed to a wall of the ionization chamber of the mass spectrometer so as to locate the ball 61 between the metal capillary 11 and the sample inlet 21 of the mass analyzer 20. As such, a side of the ball 61 facing toward the metal capillary 11 is defined as a front side F and another side of the ball 61 facing toward the mass analyzer 20 is defined as a back side B which is adjacent to the sample inlet 21 of the mass analyzer 20.

Figure 4:
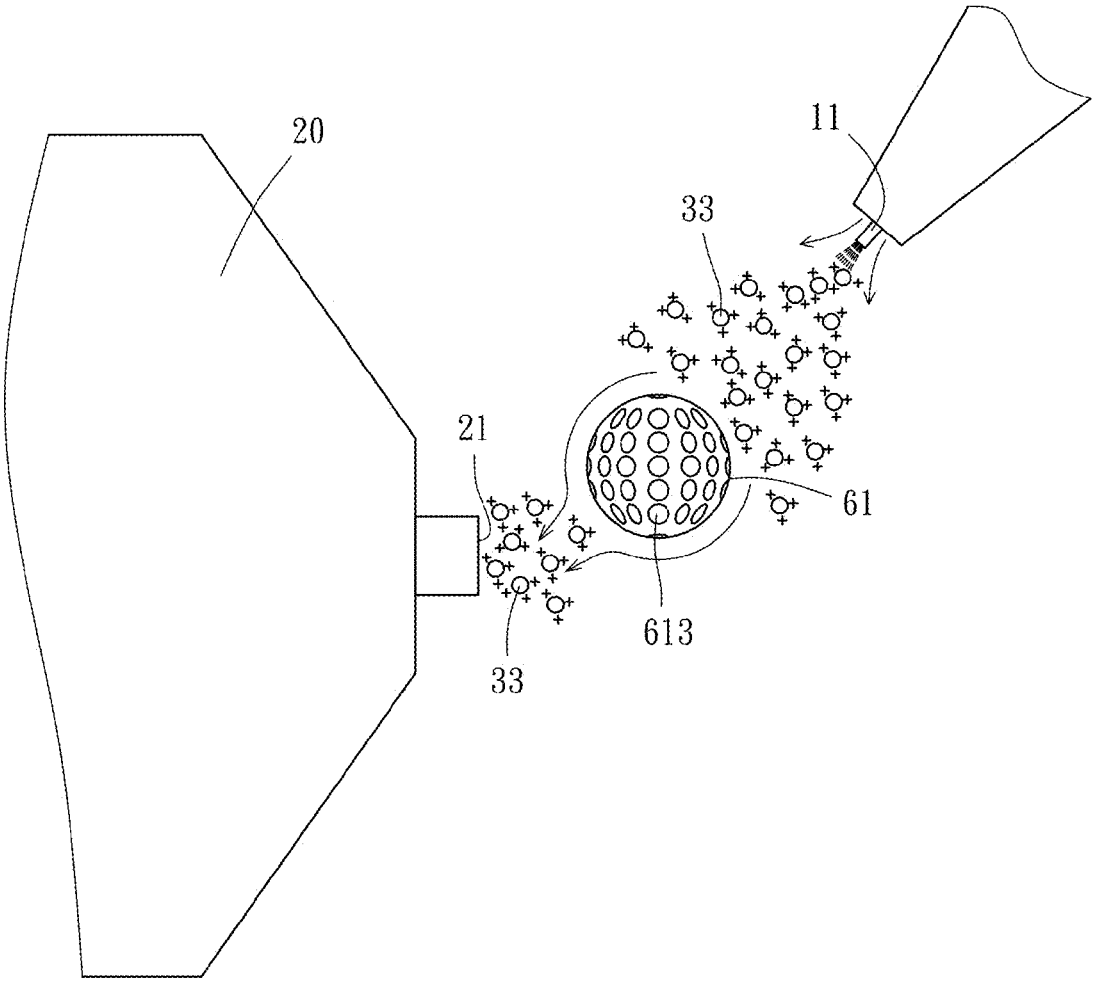
FIG. 4 is a schematic diagram showing that the ion focusing member of the preferred embodiment of the present disclosure is used to gather analyte ions.

As shown in FIG. 4, when the analyte ions 33 are sprayed from the metal capillary 11 and flow toward the front side F of the ball 61, because the laminar flow near the surface 611 of the ball 61 is disturbed by the dimples 613 on the surface 611, the plume-like analyte ions 33 can be very close to the surface 611 of the ball 61 when they flow through the ball 61 and then are gathered at a downstream position of the back side B of the ball 61. Finally, the analyte ions 33 gathered at the downstream position of the back side B enter into the mass analyzer 20 due to a potential difference established between the metal capillary 11 and the mass analyzer 20, a mass spectrum is thus obtained. With the principle of fluid dynamics, the analyte ions 33 that may be lost in the conventional ESI can be focused between the back side B of the ball 61 and the sample inlet 21 of the mass analyzer 20, thus the amount of the analyte ions 33 entering into the mass analyzer 20 can be greatly increased.

The present disclosure will further be clarified through the following Examples. However, it should be understood by those skilled in the art that the Examples are only used to illustrate the present disclosure without limiting the scope of the present disclosure. Various modification and variations can be made to present disclosure without departing from the spirit or scope of the invention.

EXAMPLE 1

Analysis of Amino Acids in Oolong Tea

First, 1 mg of oolong tea leaves were pulverized and mixed with 10 mL of ultrapure water (resistivity: 18.2 MΩ·cm). The mixture was then heated in a 90° C. water bath for 5 minutes with stirring. After cooling to room temperature, the mixture was centrifuged at 14,000 rpm for 5 minutes at 4° C. to collect the supernatant.

Figure 5:
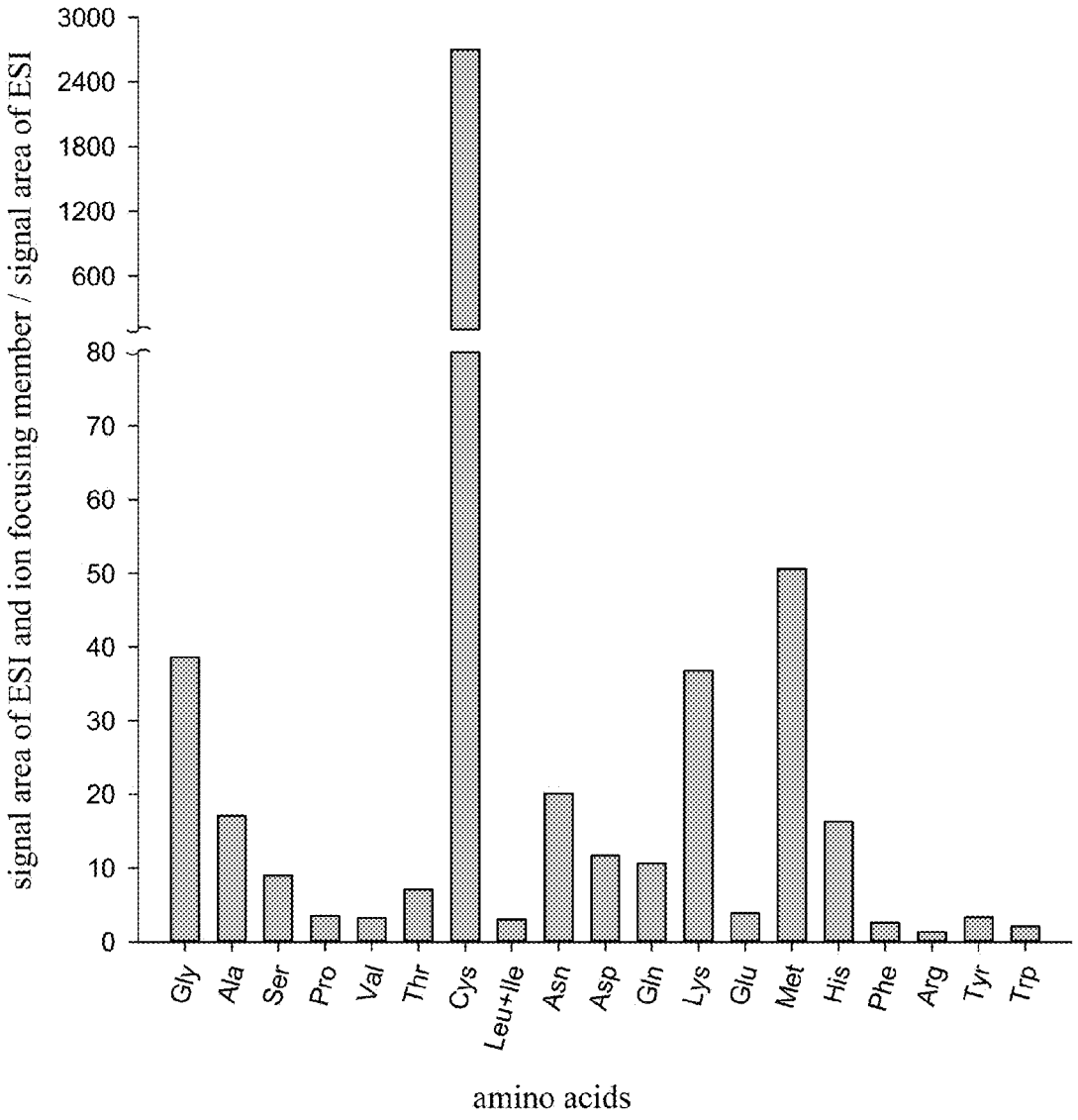
FIG. 5 is a graph showing the ratios of signal intensities of 20 amino acids in oolong tea detected respectively by a mass spectrometer equipped with a conventional ESI device and a mass spectrometer equipped with a conventional ESI device in cooperation with the ion focusing member of the present disclosure.

The mass spectrometric analyses were respectively conducted on a Finnigan TSQ Ultra EMR (purchased from Thermo Electron, San Jose, Calif., USA) equipped with only a conventional ESI device and with the conventional ESI device in cooperation with the ion focusing member of the embodiment. The results are shown in FIG. 5. The optimum parameters were as follows:

Ion source temperature: 270° C.;

Sheath gas flow rate: 50 arbitrary units;

Auxiliary gas flow rate: 10 arbitrary units; and

Spray voltage: 4.5 kV in positive scan mode.

From the results shown in FIG. 5, it is clearly that all of the signal intensities of amino acids obtained from the mass spectrometer using ESI device in cooperation with the ion focusing member of the present disclosure are higher than those obtained from the mass spectrometer using only ESI device. In addition, Cysteine (Cys shown in FIG. 5) cannot be detected by the mass spectrometer using only ESI device but can be detected by the mass spectrometer using the ion focusing member of the present disclosure. Further, for the other 19 amino acids, the signal intensities of amino acids obtained from the mass spectrometer using ESI device in cooperation with the ion focusing member of the present disclosure are increased about 2 to 51 times as compared to those obtained from the mass spectrometer using only ESI device. Therefore, it is apparently that the ion focusing member of the present disclosure can effectively increase the amount of analyte ions entering into the mass analyzer.

EXAMPLE 2

Analysis of Amino Acids in Human Urine

1 μL of human urine was mixed with ultrapure water to a total volume of 500 μL. The urine sample solution was sonicated for one minute and then was filtered and centrifuged at 14,000 rpm for 10 minutes at 4° C. in a centrifuge tube with filter to collect the urine extract.

Figure 6:
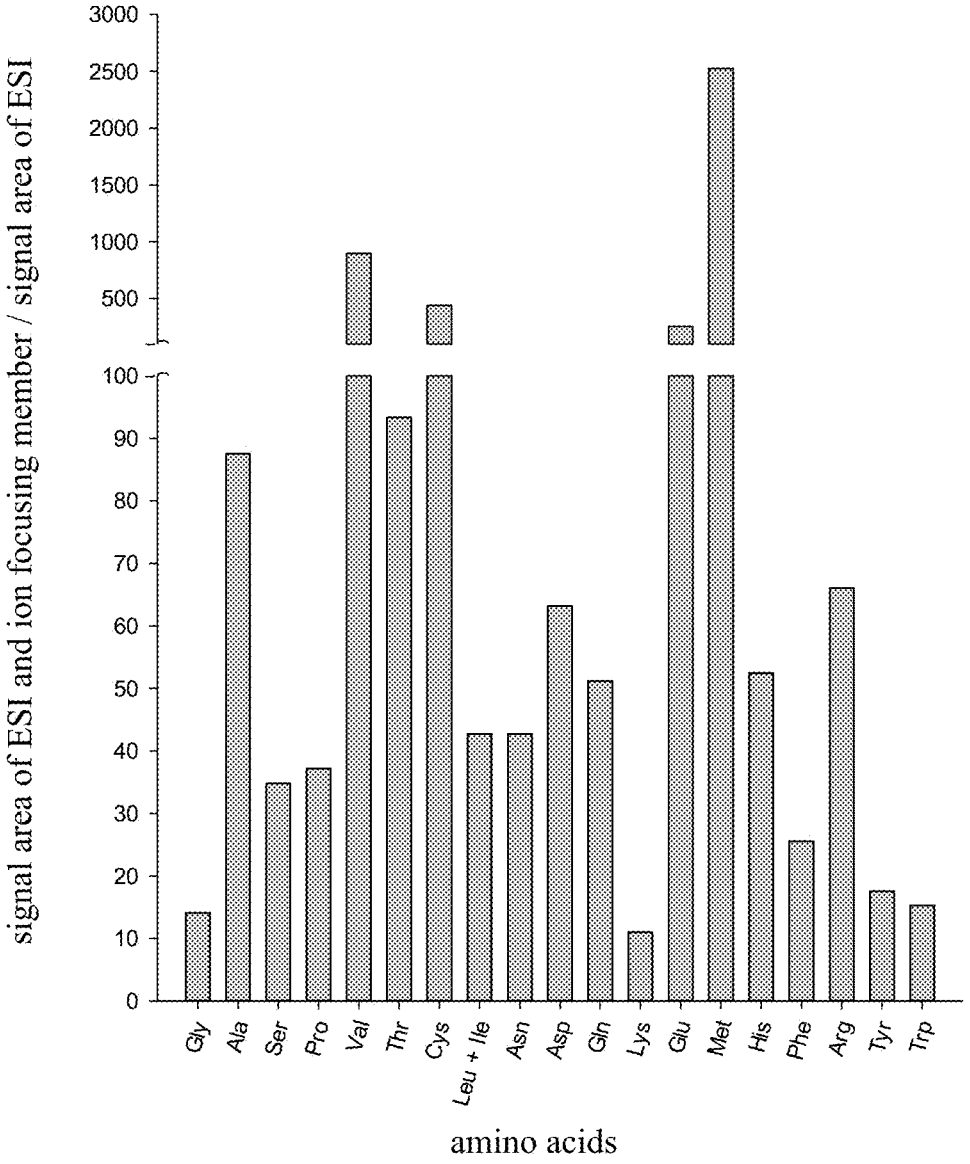
FIG. 6 is similar to FIG. 5, but showing the ratios of signal intensities of 20 amino acids in human urine.

The mass spectrometric analyses were respectively conducted on the aforesaid Finnigan TSQ Ultra EMR equipped with only the conventional ESI device and with the conventional ESI device in cooperation with the ion focusing member of the embodiment. The results are shown in FIG. 6. The optimum parameters were as follows:

Ion source temperature: 270° C.;

Sheath gas flow rate: 50 arbitrary units;

Auxiliary gas flow rate: 10 arbitrary units; and

Spray voltage: 4.5 kV in positive scan mode.

From the results shown in FIG. 6, the signal intensities of amino acids obtained from the mass spectrometer using ESI device in cooperation with the ion focusing member of the present disclosure are apparently higher than those obtained from the mass spectrometer using only ESI device. In addition, Cysteine (Cys) cannot be detected by the mass spectrometer using only ESI device but can be detected by the mass spectrometer equipped with the ion focusing member of the present disclosure. For the other 19 amino acids, the signal intensities of amino acids obtained from the mass spectrometer using ESI device in cooperation with the ion focusing member of the present disclosure are increased about 11 to 2525 times as compared to those obtained from the mass spectrometer using only ESI device.

EXAMPLE 3

Analysis of Amino Acids in Human Serum

1 μL of human serum was mixed with ultrapure water to a total volume of 500 μL. The serum sample solution was sonicated for one minute and then was filtered and centrifuged at 14,000 rpm for 10 minutes at 4° C. in a centrifuge tube with filter to collect the serum extract.

Figure 7:
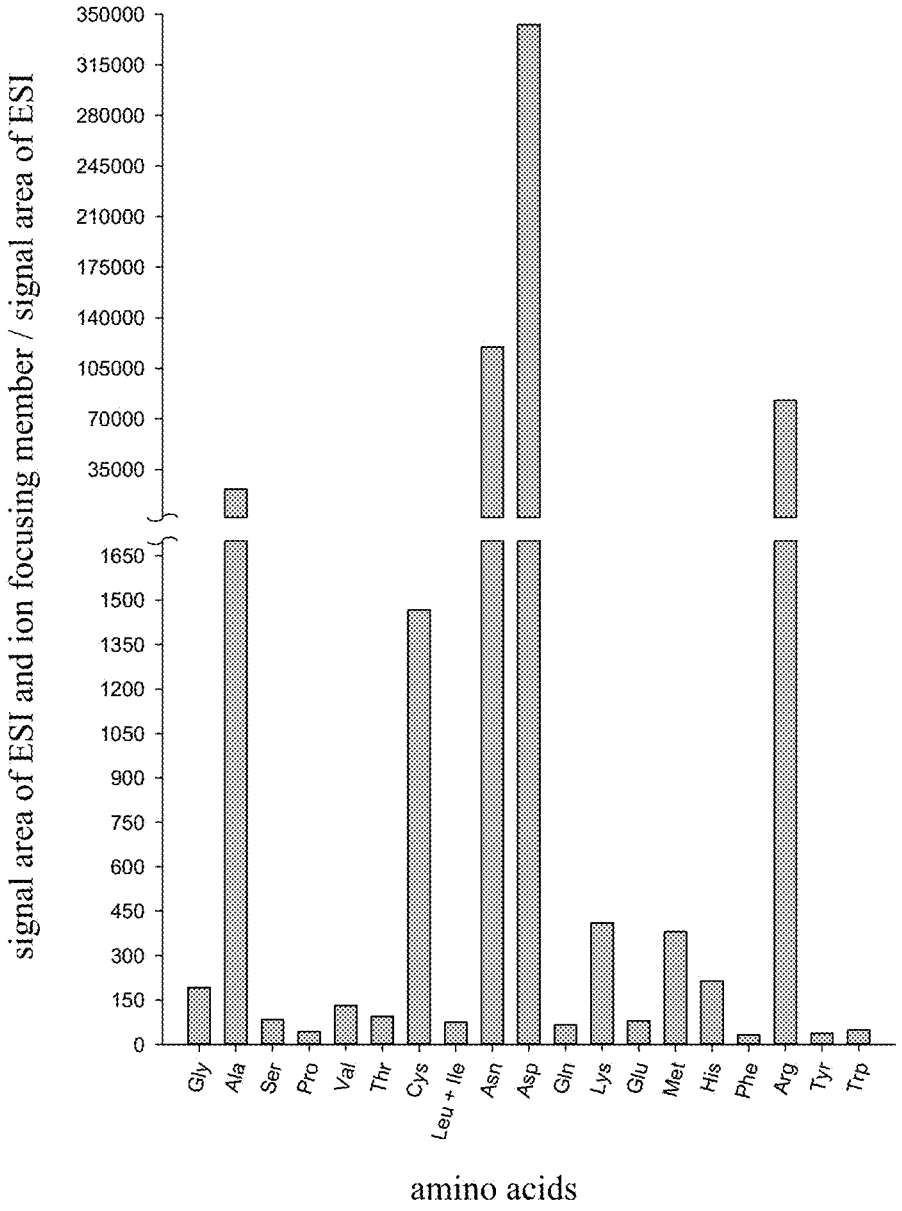
FIG. 7 is similar to FIG. 5, but showing the ratios of signal intensities of 20 amino acids in human serum.

The mass spectrometric analyses were respectively conducted on the aforesaid Finnigan TSQ Ultra EMR equipped with only the conventional ESI device and with the conventional ESI device in cooperation with the ion focusing member of the embodiment. The results are shown in FIG. 7. The optimum parameters were as follows:

Ion source temperature: 270° C.;

Sheath gas flow rate: 50 arbitrary units;

Auxiliary gas flow rate: 10 arbitrary units; and

Spray voltage: 4.5 kV in positive scan mode.

From the results shown in FIG. 7, the signal intensities of amino acids obtained from the mass spectrometer using ESI device in cooperation with the ion focusing member of the present disclosure are significantly higher than those obtained from the mass spectrometer using only ESI device. In addition, Glycine (Gly), Alanine (Ala), Cysteine (Cys), Asparagine (Asn), Aspartate (Asp), and Arginine (Arg) cannot be detected by the mass spectrometer using only ESI device but can be detected by the mass spectrometer equipped with the ion focusing member of the present disclosure. For the other 14 amino acids, the signal intensities of amino acids obtained from the mass spectrometer using ESI device in cooperation with the ion focusing member of the present disclosure are increased about 31 to 1467 times as compared to those obtained from the mass spectrometer using only ESI device.

From the results shown in the above examples 1 to 3, when the ion focusing member of the present disclosure is applied to the mass spectrometer equipped with conventional ESI device, the analysis of amino acids in complicated matrix can effectively be conducted even in the case where the concentration of the sample is low. As such, the ion focusing member of the present disclosure is contributed to the analysis of micro-biochemical sample.

As described above, because the ion focusing member of the present disclosure can effectively gather the plume-like analyte ions in a location adjacent to the sample inlet of the mass analyzer, the amount of analyte ions entering into the mass analyzer can be significantly increased so as to improve ion transmission efficiency. Accordingly, when the present disclosure is used in a mass spectrometer, the mass spectrometer may have the advantages of increased signal intensity of analyte, minimized detection error and lowered detection limit. Furthermore, the present disclosure is widely used because it can be directly combined with the existing mass spectrometer.

What is claimed is:

1. An ion focusing member adapted for being disposed in a mass spectrometer including a metal capillary for spraying analyte ions and a mass analyzer having a sample inlet, the ion focusing member comprising:

a ball having a surface with a plurality of dimples, a front side for facing toward the metal capillary, and a back side for facing toward and being located adjacent to the sample inlet of the mass analyzer;

wherein the ball is adapted to be disposed at a spray path of the analyte ions, such that when the analyte ions are sprayed to the front side of the ball, the analyte ions flow along the surface of the ball to be collected at a downstream position of the back side of the ball, which in turn flow toward the sample inlet of the mass analyzer because of a potential difference established between the metal capillary and the mass analyzer.

2. The ion focusing member as claimed in claim 1, wherein each of the plurality of dimples on the surface of the ball has a diameter of between 1 nm and 1 mm.

3. The ion focusing member as claimed in claim 1, wherein each of the plurality of dimples on the surface of the ball has a depth of 1 nm to less than a radius of the ball.

4. The ion focusing member as claimed in claim 1, wherein the ball is made of a material resistant to acidic and basic solutions, organic solvents, and a high temperature of 260° C. or more.

5. The ion focusing member as claimed in claim 4, wherein the ball is made of polyetheretherketone, polyimide, ceramic, or glass.

6. A mass spectrometer, comprising:

a mass analyzer having a sample inlet;

a metal capillary for spraying analyte ions; and an ion focusing member as claimed in claim 1 which is located at a spray path of the analyte ions and located between the sample inlet of the mass analyzer and the metal capillary.

* * * * *